US005349918A

United States Patent [19]

Elie

[11] Patent Number: 5,349,918

[45] Date of Patent: Sep. 27, 1994

[54] MODULAR TWIN HULL BOAT

[75] Inventor: Christian Elie, Outremont, Canada

[73] Assignee: Pelican International, Québec, Canada

[21] Appl. No.: 71,054

[22] Filed: Jun. 4, 1993

[51] Int. Cl.[5] ..... B63B 7/04

[52] U.S. Cl. ..... 114/352; 114/61; 440/26

[58] Field of Search ..... 114/61, 267, 352, 353, 114/354; 440/26, 27

[56] References Cited

U.S. PATENT DOCUMENTS 4,698,034 10/1987 Anthonijsz .
4,768,454 9/1988 Selken ..... 114/353
4,828,517 5/1989 van Liefland .

FOREIGN PATENT DOCUMENTS 2523068 9/1983 France .
7802634 9/1979 Netherlands .
1000068 8/1965 United Kingdom .
2119721 11/1983 United Kingdom .

OTHER PUBLICATIONS

Popular Science Issue of Jun. 1954, p. 121.

*Primary Examiner*—Jesûs D. Sotelo
*Attorney, Agent, or Firm*—Robic

[57] ABSTRACT

The modular boat has an improved assembly which is more compact when disassembled and is more solid when assembled. The boat comprises two side cockpit members, a transverse bow member, a transverse stern member and a middle member covering an opening between the side members. The side members each provide a middle portion of a hull with the bow portion and stern portion of each hull being provided by the bow member and the stern member respectively.

16 Claims, 3 Drawing Sheets

MODULAR TWIN HULL BOAT

FIELD OF THE INVENTION

The present invention relates to a modular boat. More particularly the present invention relates to a modular catamaran or twin hull boat.

BACKGROUND OF THE INVENTION

Collapsible and modular water crafts are known in the art for the purposes of providing small pleasure craft able to be transported more easily in a disassembled form and reassembled before use. It is known to provide hull constructions in which independent floating hull sections are assembled to form a larger continuous hull as is disclosed in the June 1954 issue of Popular Science at page 121 and in Dutch patent publication NL 7,802,634. It is also known in British patent publication GB 2,119,721 to build a catamaran in which bow and stern portions of each pontoon or hull are connected together to form a pair of floats. The floats are then interconnected by a member which supports a seat.

In the prior art configurations, the modules making up the boat are not very compact as individual units, and transport of the boat before assembly requires the transport of one or more elements of relatively large dimensions.

SUMMARY OF THE INVENTION

The present invention provides a modular twin hull boat for two persons in which each hull is formed of three portions, namely a middle portion, a bow portion and a stern portion, the three portions being connectable together to provide a continuous hull. When the middle portion includes a cockpit by providing the hull in three portions, the boat is given good buoyancy while reducing the length of the middle portion to as little as the required length for receiving the person in the cockpit, with the bow and stern portions add greater buoyancy.

According to the invention there is provided a modular twin hull boat for two persons comprising two elongate side members each providing a middle portion of a hull, bow means connectable to a bow side of the side members for providing a bow portion of the hull continuous with the middle portion, stern means connectable to a stern side of the side members for providing a stern portion of the hull continuous with the middle portion, and means for connecting the side members together and to the bow means and the stern means with the side members parallel and separated.

Preferably, the side members include a cockpit for receiving a person, and the connecting means provided between the side members and the stern means include an upper flange provided on the side members for engagingly resting on a lower flange of the stern means, so that the buoyancy of the stern means causes the upper and lower flanges to engage one another. According to another preferred feature of the invention, the bow means and the stern means each comprise integral members including an upper transverse member, a length of said transverse members and a length of the two side members being approximately equal.

BRIEF DESCRIPTION OF THE DRAWINGS

The invention will be better understood by way of the following non-limiting detailed description of a preferred embodiment with reference to the drawings in which.

DETAILED DESCRIPTION OF THE PREFERRED EMBODIMENT

Figure 1:
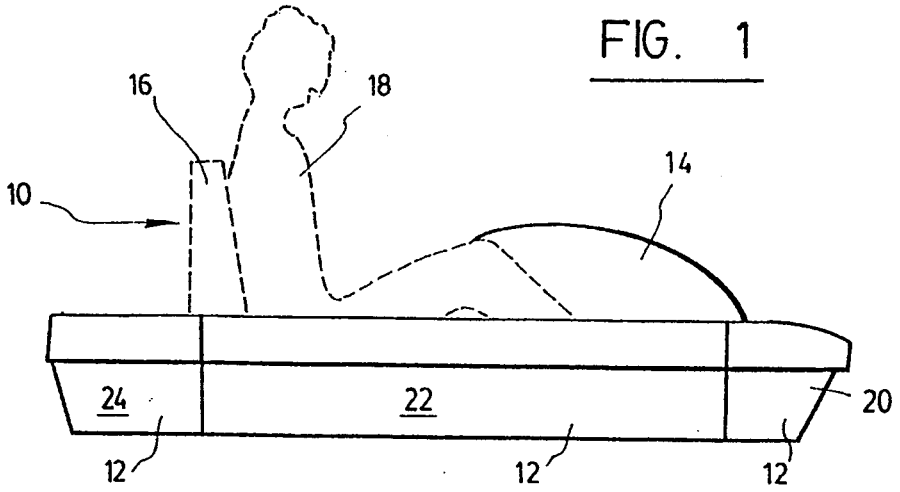
FIG. 1 is a side view of a pedal boat according to the preferred embodiment.
Figure 2:
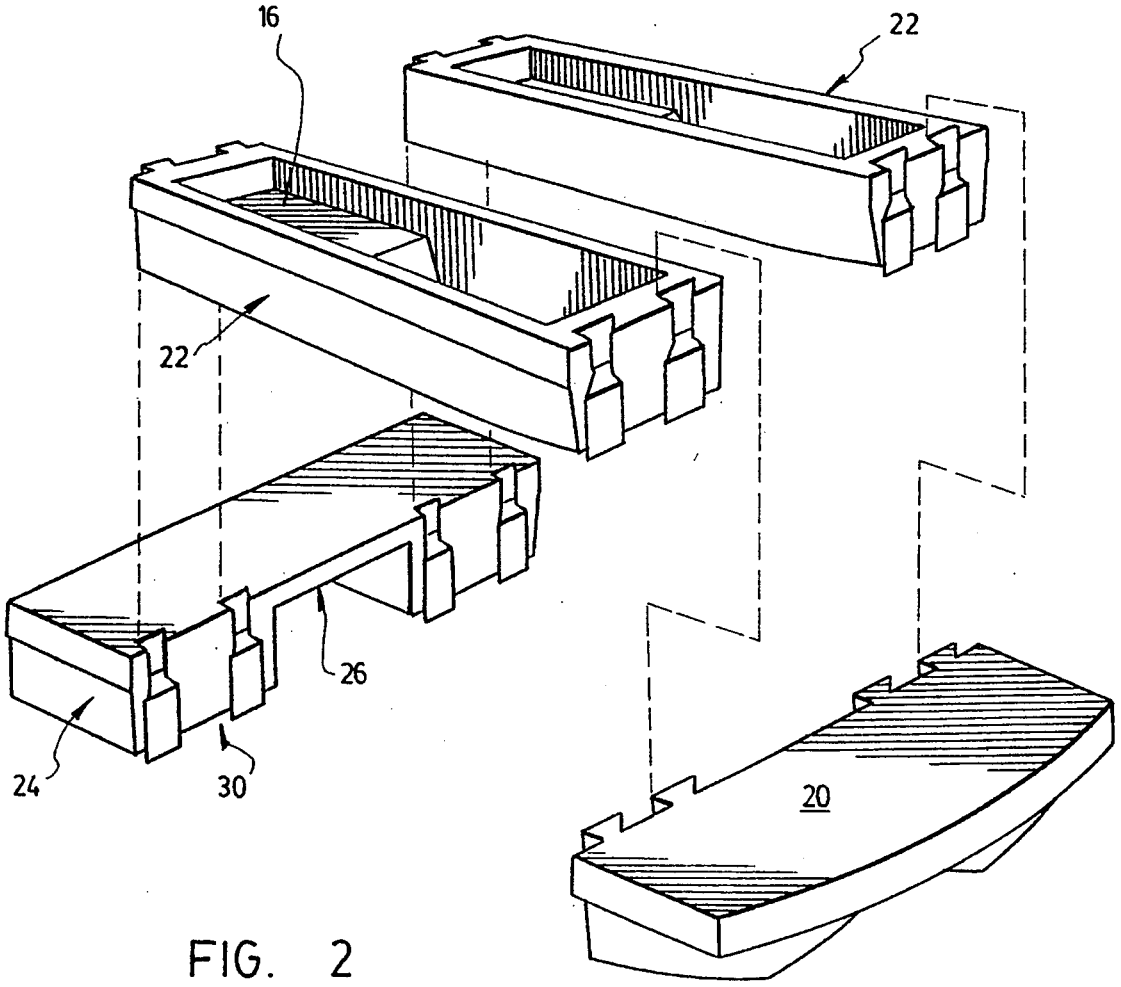
FIG. 2 is an exploded view of the side bow and stern float members according to the preferred embodiment.

In the preferred embodiment, the modular twin hull boat (10) is made up of three basic modules (FIG. 1), namely a middle side member (22), a bow member (20) and a stern member (24) which together form two unitary hulls (12). The boat (10) is a leisure pedal boat, and a middle member (14) is provided which can house pedals and a paddle system (not shown). As shown in FIG. 2, each side member (22) includes a seat (16) and a pedal footwell provided inside a cockpit of each side member (22). A twin dovetail connection (30) is provided for connecting the stern side of the side members (22) to stern member (24), and similarly a bow side of side members (22) is connected to bow member (20).

Figure 3:
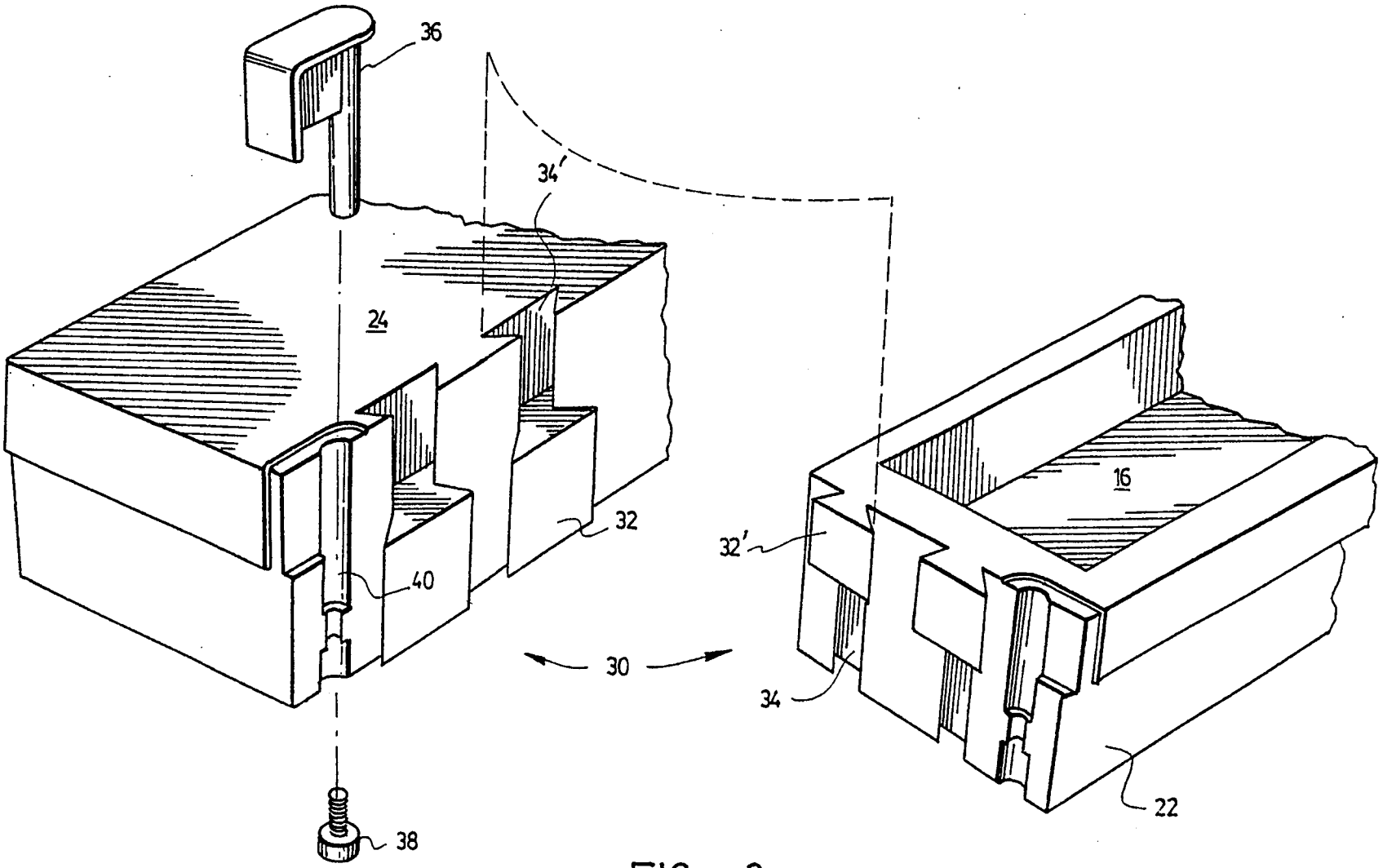
FIG. 3 is a detailed view of the connecting dovetail joint between one side member and the stern member.

As shown in FIG. 3, the dovetail connection includes upper dovetail tenons (32') fitting into upper dovetail mortises (34') and lower dovetail tenons (32) fitting into lower dovetail mortises (34). In this way, tenons (32') rest upon tenons (32) as member (22) is plugged vertically onto member (24). Tenons (32') act as an upper flange and tenons (32) act as a lower flange such that the upper flange rests upon the lower flange in such a way that the buoyancy of member (24) causes the lower flanges to engage the upper flanges. A side connecting member (36) is placed through an appropriate bore (40) provided in members (22) and (24) which keeps the upper and lower flanges together once fastened by bottom bolt (38). Similar connection means are provided for connecting the side members (22) to bow member (20) except that the mortises (34) of member (22) are on top.

Figure 4:
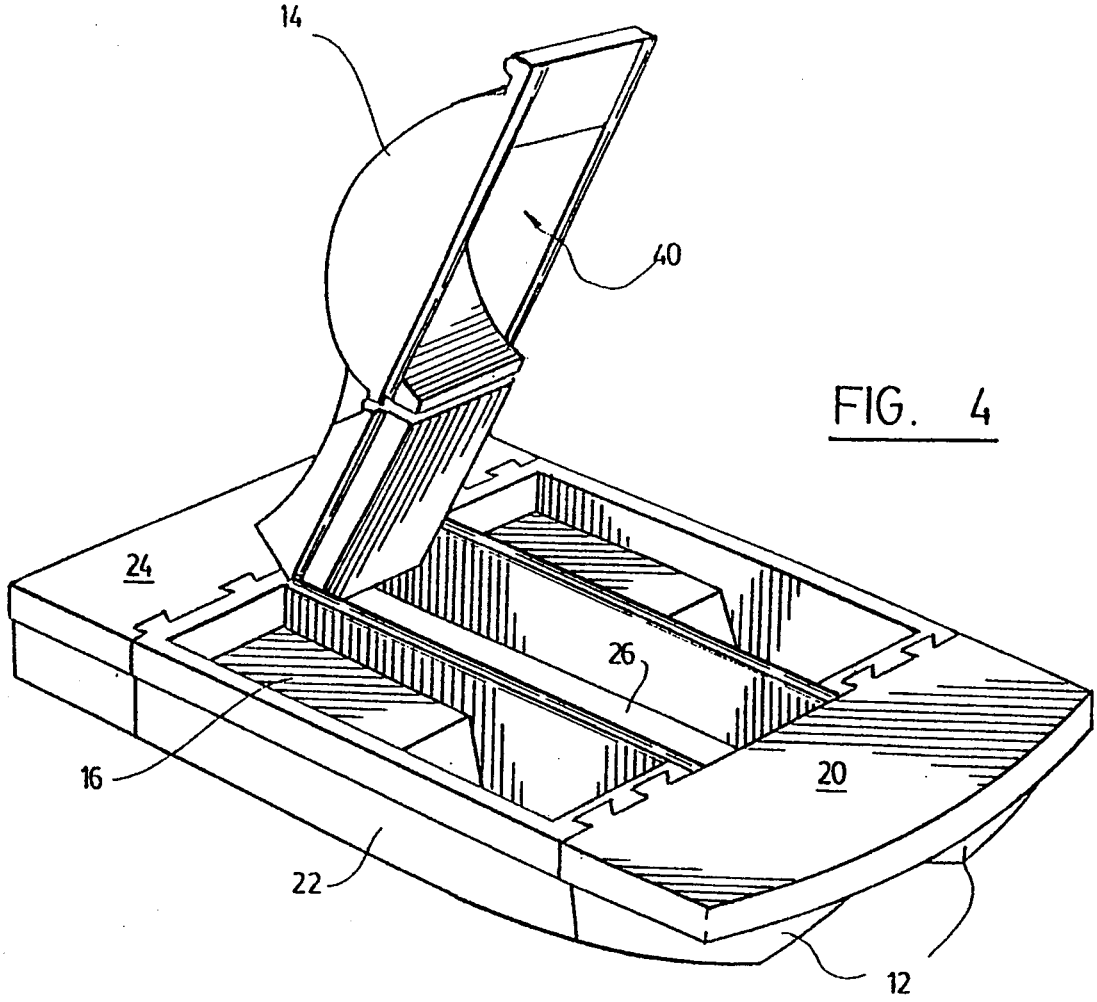
FIG. 4 is a perspective view of the assembled twin hull with the middle member being installed.
Figure 5:
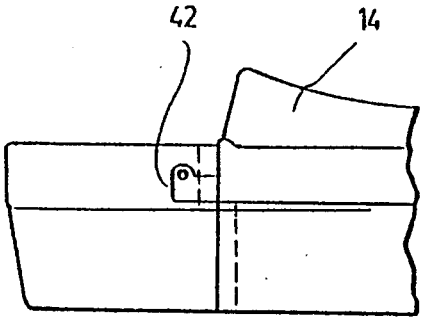
FIG. 5 is a detailed lengthwise section illustrating the attachment of the middle member to the stern member.

With reference to FIGS. 4 and 5, one can see that hulls (12) are interconnected by bow member (20) and stern member (24) with an opening (26) provided therebetween. The opening (26) between members (20) and (24) is covered by member (14) which has a rearward projection (42) which engages from underneath a recess in an upper member interconnecting the two hull portions of member (24), and member (14) also has side edges (44) which rest on upper lips (46) of the inner sides of members (22).

When assembling boat (10), stern member (24) is placed first on the ground and side members (22) are connected thereto. Middle member (14) is placed with projection (42) inserted into the recess of stern member (24) and lowered so that side grooves (44) fit over rounded edges (46). Bow member (20) is then placed over members (22) and (14), with projection (42') being received by a recess (not shown) in bow member (20).

With fasteners (36) and (38) connected at the bow, the boat (10) is assembled. To make the interconnection more solid, fasteners (36) and (38) are provided at the stern, and a bolt interconnecting member (14) to bow member (20) may be provided for a central connection.

It can be appreciated that the specific arrangement according to the preferred embodiment provides a solidly connected assembly with a minimum number of components.

The upper members of bow member (20) and stern member (24) have flat upper deck surfaces which can be used as a small deck surface or raft for swimmers.

All of members (14) (22) (20) and (24) can be molded from plastic using blow molding or rote-molding techniques whereby the members are watertight floats as individual components. In the preferred embodiment, the length, width and height of members (14) (20) (22) and (24) are approximately equal such that boat (10) can be shipped in five boxes of approximately the same size and shape, or the modular components can be more densely packed in a larger shipping container.

Although the connection (30) has been illustrated in the preferred embodiment as comprising dual dovetail joints, it is to be understood that other connections are possible. For example, the upper dovetail tenons may be replaced by a single upper flange contacting a single lower flange (32) provided that another connector such as member (36) or the like is used to keep members (22) and (24) fastened together. Although the members (20) and (24) are shown to include upper deck surfaces interconnecting the hulls (12) together, it would be possible to interconnect hulls (12) by means of another member such as middle member (14) alone.

What is claimed is:

1. A modular twin hull boat for two persons comprising:

two elongated side members each providing a middle portion of a hull, said side members including cockpit for receiving a person;

bow means connectable to a bow side of said side members for providing a bow portion of said hull continuous with said middle portion, said cockpit having a footwell at the bow side;

stern means connectable to a stern side of said side members for providing a stern portion of said hull continuous with said middle portion, said cockpit having a seat at the stern side; and means for connecting said side members together and to said bow means and said stern means with said side members parallel and separated, said connecting means including an upper flange connected to said side members at said stern side and a lower flange connected to said stern means, a lower surface of said upper flange for engaging an upper surface of said lower flange, whereby a buoyancy of said stern means causes said flanges to engage.

2. Boat as claimed in claim 1, wherein:

said bow means comprise an upper member interconnecting said bow portion of each said hull;

said stern means include an upper member interconnecting said stern portion of each said hull;

a transverse length of said bow means and said stern means being approximately equal to a length of said two side members; and a transverse width of said bow means and said stern means being approximately equal to a width of said two side members.

3. Boat as claimed in claim 2, further comprising a middle member covering an opening between said side members and said upper members of said bow means and said stern means.

4. Boat as claimed in claim 3, wherein said middle member has a groove on each side engaging from above a corresponding lip on each inner side of said side members, and has a rearwardly projecting member engaging an underside of said upper member of said stern means, whereby when said middle member is connected in place it helps to prevent said upper and lower flanges from disengaging.

5. Boat as claimed in claim 4, wherein said middle member includes a forwardly projecting member engaging an underside of said upper member of said bow means, and said connecting means include a lower flange connected to said side members at said bow side, an upper flange connected to said bow means for engaging an upper surface of the lower flange of the side members, and means for holding said upper flange of the bow means and said lower flange of the side members in engagement.

6. Boat as claimed in claim 5, wherein said upper and said lower flanges comprise dovetail tenons, and said connecting means further comprise corresponding dovetail mortises for receiving said tenons.

7. Boat as claimed in claim 6, wherein said upper flange and said lower flange each comprise a pair of dovetail tenons, and bolt means are provided for holding said upper and said lower flanges in engagement.

8. Boat as claimed in claim 1, wherein said upper and said lower flanges comprise dovetail tenons, and said connecting means further comprise corresponding dovetail mortises for receiving said tenons.

9. Boat as claimed in claim 8, wherein said upper flange and said lower flange each comprise a pair of dovetail tenons, and bolt means are provided for holding said upper and said lower flanges in engagement.

10. Boat as claimed in claim 1, wherein said connecting means further comprise bolt means for holding said upper flange and said lower flange in engagement.

11. A modular twin hull boat for two persons comprising:

two elongated side members each providing a middle portion of a hull;

bow means connectable to a bow side of said side members for providing a bow portion of said hull continuous with said middle portion, said bow means comprising an upper member interconnecting said bow portion of each said hull stern means connectable to a stern side of said side members for providing a stern portion of said hull continuous with said middle portion, said stern means including an upper member interconnecting said stern portion of each said hull;

a transverse length of said bow means and said stern means being approximately equal to a length of said two side members;

a transverse width of said bow means and said stern means being approximately equal to a width of said two side members; and means for connecting said side members together and to said bow means and said stern means with said side members parallel and separated.

12. Boat as claimed in claim 11, further comprising a middle member covering an opening between said side members and said upper members of said bow means and said stern means.

13. Boat as claimed in claim 12, wherein said upper member of said bow means and said stern means extend to completely cover and seal said bow portion and said stern portion respectively, whereby said bow means and said stern means are watertight and said upper members provide deck surfaces at the bow and the stern.

14. Boat as claimed in claim 12, wherein each said side member is provided with a seat and a pedal receiving footwell, said boat being a pedal boat.

15. Boat as claimed in claim 11, wherein each said side member is provided with a seat and a pedal receiving footwell, said boat being a pedal boat.

16. Boat as claimed in claim 11, wherein each said side member provides a cockpit having a seat and a pedal receiving footwell, said boat being a pedal boat.

* * * * *